United States Patent [19]

Svensson

[11] 4,262,617

[45] Apr. 21, 1981

[54] DEVICE FOR SIMPLIFYING THE SETTING AND TAKING IN OF SAILS

[76] Inventor: Johan A. Svensson, Smedjegatan 2, 652 23 Karlstad, Sweden

[21] Appl. No.: 118,804

[22] PCT Filed: Jul. 9, 1979

[86] PCT No.: PCT/SE78/00051

§ 371 Date: Jul. 9, 1979

§ 102(e) Date: Jul. 9, 1979

[87] PCT Pub. No.: WO79/00272

PCT Pub. Date: May 17, 1979

[30] Foreign Application Priority Data

Nov. 8, 1977 [SE] Sweden ..... 7712574

[51] Int. Cl.[3] ..... B63H 9/10

[52] U.S. Cl. ..... 114/104

[58] Field of Search ..... 114/102, 104, 105; 138/133, 134; 150/52 R; 229/55

[56] References Cited

U.S. PATENT DOCUMENTS

| | | | |
|---|---|---|---|
| Re. 29,279 | 6/1977 | Fretwell | 114/104 |
| 2,396,059 | 3/1946 | Roberts | 138/133 |
| 2,595,110 | 4/1952 | Steube et al. | 114/104 |
| 4,102,289 | 7/1978 | Ebbeson et al. | 114/104 |
| 4,157,073 | 6/1979 | Vall | 114/102 |

FOREIGN PATENT DOCUMENTS

| | | | |
|---|---|---|---|
| 403460 | 11/1978 | Sweden | 114/104 |
| 1528103 | 10/1978 | United Kingdom | 114/104 |

*Primary Examiner*—Charles E. Frankfort

*Attorney, Agent, or Firm*—Murray and Whisenhunt

[57] ABSTRACT

A device for simplifying the setting and taking in of spinnakers comprises a helix (7) which can be longitudinally expanded to a length corresponding to the length of the sail (1). One end of the helix is fastened in the running rigging of the boat adjacent to the head of the sail. A downhaul pulls the helix down over the sail such that the helix is successively stretched out to embrace the sail, and an uphaul is also provided for recontracting the helix from the expanded condition in order to release the sail.

12 Claims, 4 Drawing Figures

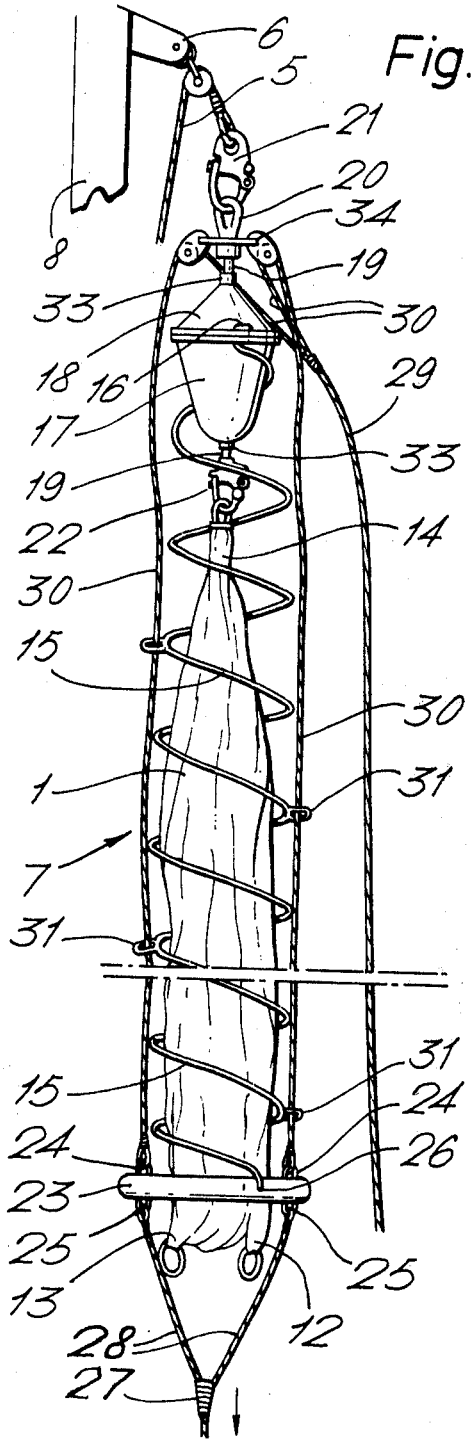
Fig.2.
Fig.3.
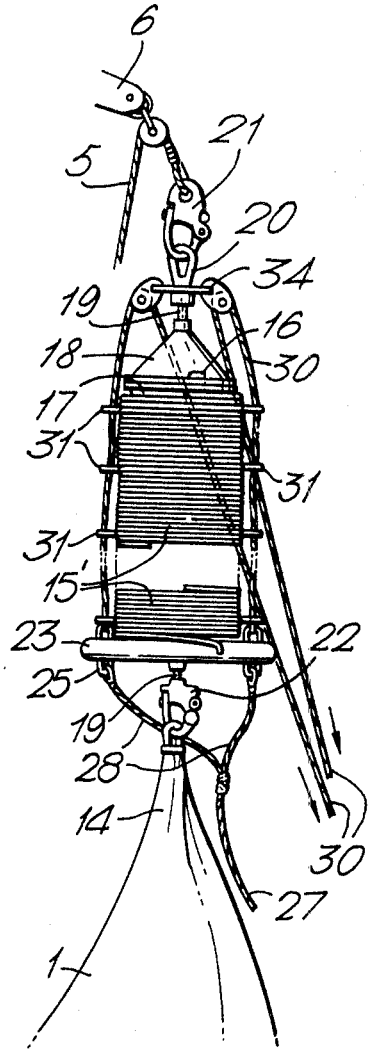

DEVICE FOR SIMPLIFYING THE SETTING AND TAKING IN OF SAILS

The present invention relates to a device for simplifying the setting and taking in of sails, particulary spinnakers.

Most crews in sailing boats usually set their spinnakers directly out from sail bags, spinnaker boxes or plastic baskets secured on the foredeck or on the leeside of the shrouds. Even for skilled crews this work is often arduous and in strong wind or heavy sea even dangerous. A common way of setting the spinnaker therefore is to hoist it wooled, that is to say with the weather and leeward bolt ropes close together, and the whole sailcloth rolled up all the way to the bolt ropes, and all of it bound up by means of short pieces of wool so that the sail resembles a string of sausages. The wool pieces are easily torn off when a pulling force is supplied to the sheets. By utilizing this system it is possible to rig everything in advance without the sail filling as soon as it is hoisted. When the wind is fresh even the most skilled crews hoist their spinnakers wooled particularly on ocean racers, so that the spinnakers will not become tangled. This method, of course, requires a detailed and careful preparation. Even if problems concerned with setting the spinnakers can be managed by wooling, there still remains often very difficult problems which may arise when the spinnakers are to be taken in and stowed away.

More permanent devices therefore have been suggested which aim at simplifying the setting and taking in of spinnakers. Such a previously proposed device is disclosed in U.S. Pat. No. 2,595,110 and a similar one in Swedish Pat. No. 389,074. These previous devices principally consist of a hose-shaped casing made from a thin textile material which is pulled down over the sail starting from the head so that the sail is successively compacted in the hose-shaped casing. When the sail is to be set the operation is reversed so that the sail is successively released. The device, however, has never become popular which may be due to problems arising from the need to compact the casing itself at the top of the mast when the spinnaker has to be set. Further the surface of friction between the inner side of the casing and the material of the sail is considerable. Particularly when the sail is wet there are considerable problems concerned with the material of the sail sticking to the casing when the latter has to be hoisted ro release the sail.

A device which can eliminate most of the above drawbacks is disclosed in U.S. Pat. No. 3,861,343. In this device the hose-shaped casing is replaced by a number of rings which are united by means of spacing lines provided with spacing means. The spacing lines can run through holes or the like in the rings so that the rings can be separated from each other as far as the spacing means permit. In a modified embodiment marketed under the trade name "Spinnaker Sally" the spacing lines are secured by knots to each individual ring. The large number of details make this device comparatively complicated, as is illustrated by FIG. 4 of U.S. Pat. No. 3,861,343. The risk of tangling is apparent. Further the large number of details makes it difficult to make a compact package of the device. Another drawback with this prior construction is that the rings strangle the sail within the concentrated regions of the rings. The pressure in the regions of the rings therefore can be considerable and hence also the friction between the sail and the rings, even if the rings are made from a material having a low friction coefficient. Further it is a weakness that the strength of the entire device is dependent on the strength of the spacing lines between the individual rings. Another restriction of this previous device is due to the fact that the distances between the rings must necessarily be considerable in order that the entire device, including the spacing lines, and optional supplementary spacing means, shall not be too clumsy. The considerable distances between the rings in their turn may cause the sail not to be embraced as efficiently by the device as is sometimes desired.

It is an object of the present invention to provide an improved device which in an "expanded condition" may have an adaptable length so that one and the same device may be used for sails of different lengths. "Expanded condition" is this context means that no part of the device is compacted. This feature is of importance as it is a prerequisite for a rationally planned production and stock-keeping of the device.

Still another object is to provide a device which is very reliable and at the same time extremely uncomplicated and hence comparatively inexpensive to manufacture.

According to this invention, there is provided a device for simplifying the setting and taking in of sails, characterised in that the device comprises a helix which in a longitudinally expanded condition has a length which may correspond to the length of the sail; in that one end of the helix is adapted to be fastened in the running rigging of the boat adjacent to the head of the sail; in that means are provided for pulling the other end of the helix down over the sail such that the helix is stretched out to embrace the sail; and in that means are provided for recontracting the helix from the expanded condition so as successively to release the sail.

Further features and advantages of the invention will be apparent from the following description given with reference to the accompanying drawings, in which:

FIG. 2 shows a doused spinnaker, with the device of FIG. 1 being shown more in detail;

FIG. 3 shows the device according to the same embodiment of the invention, the helix being maximally contracted to form a compact package when the spinnaker is set and the sail is filled by the wind.

Figure 1:
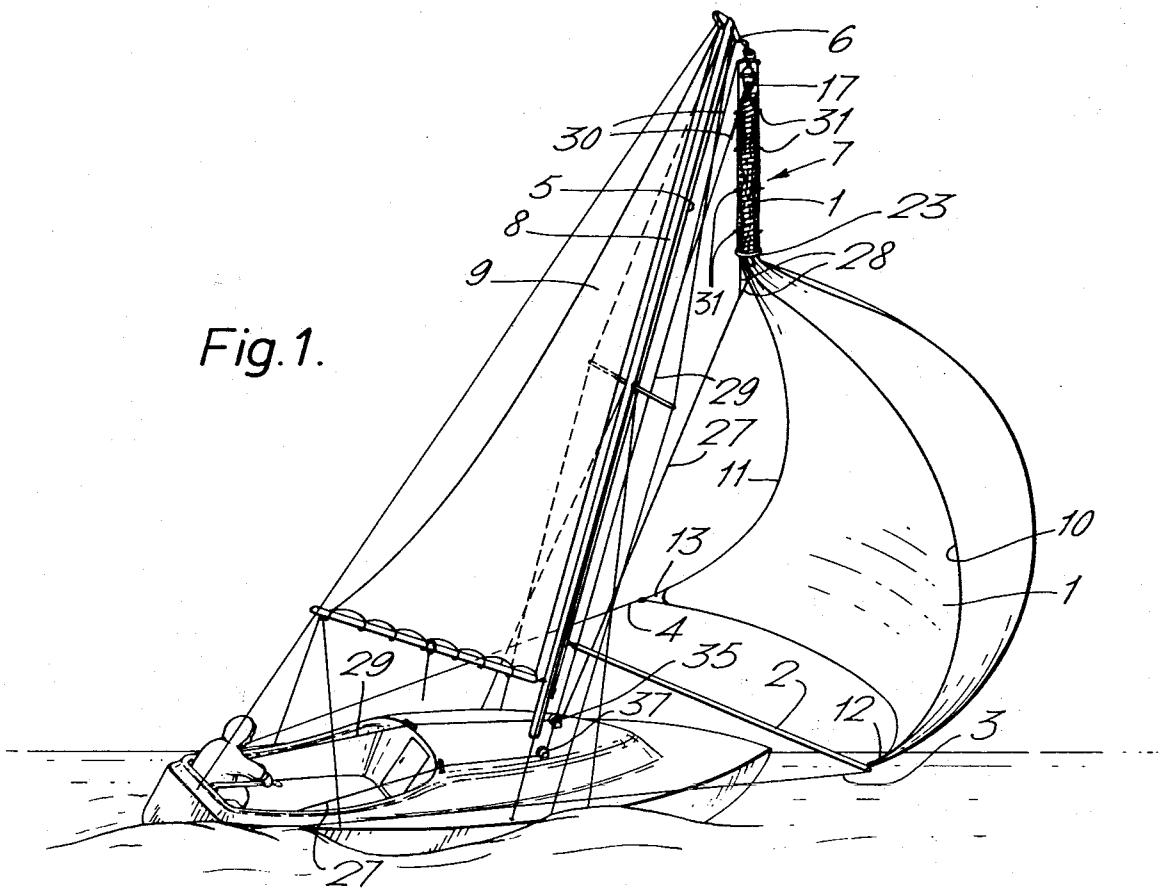
FIG. 1 is a perspective view showing a boat with a spinnaker which is being doused (or being set) by means of one embodiment of device according to this invention.

In the drawings only those details are shown which are required for the understanding of the invention, other details having been omitted.

Referring first to FIG. 1, the main parts of the spinnaker equipment on board the illustrated boat are a spinnaker 1, a spinnaker pole 2 with a guy 3, a leeward sheet 4, a halyard 5 with a halyard block 6, and the device of the invention which is generally designated 7. The mast of the boat has been designated 8 and the main sail 9. The spinnaker has a windward bolt rope 10, a leeward bolt rope 11, a tack 12, a clew 13 and a head 14 (FIGS. 2 and 3).

The device 7 comprises a longitudinally expandable helix generally shown as 15 made from a rigid material which may readily glide against the material of the sail. The helix 15 may, for example, be made of a rigid plastic material or of a, preferably elastic, stainless steel. The helix 15 may, preferably under the influence of spring action, be contracted to form a compact package 15' as is illustrated in FIG. 3. In the package 15' the individual turns of the helix lie close to each other. In its expanded condition, FIG. 2, the helix 15 embraces the spinnaker along the entire length of the sail. One and the same helix 15 may be used for spinnakers having lengths varying within a comparatively broad range due to the fact that the degree of expansion can be varied within wide limits.

The upper end 16 of the helix 15 is fastened in a flange joint uniting a lower and an upper cone 17 and 18, respectively. The lower cone 17 serves as a centering means for the helix when the helix has to be contracted to a compact package 15'. The upper cone 18 is given a considerably shorter length as is apparent from the drawings. The cones 17 and 18 are suitably made from press-moulded plastic. Also metal and other materials, however, may be used. For example a stainless steel wire structure can be used for the same purpose, the structure having a design similar to the cones 17 and 18. Along the common axis of symmetry through the cones 17 and 18, there is provided a bolt 19. The bolt 19 is secured to the cones 17 and 18 by means of suitably threaded metal bushings 33 so that 17 and 18 and 19 form a tight unit. The upper end of the bolt 19 is provided with an eye 20 and a snap shackle 21 which is fastened to the halyard 5. The lower end of the bolt 19 is provided with a snap shackle 22 which is fastened to the head 14 of the spinnaker.

The lower end 26 of the helix 15 is fastened to a ring, sleeve, funnel or corresponding means with an inner diameter corresponding at least to the diameter of the helix 15. Means known per se may be used for this purpose, as for example means shown in FIG. 5 in U.S. Pat. No. 2,595,110 or a funnel-like member of the kind illustrated in Swedish Pat. No. 389,074. According to the preferred embodiment, however, use is made of just a simple ring 23, which has been proved to work very well. The ring 23 by way of example may consist of a rigid plastic tube which has been bent to form a ring. A pair of loops 24 and 25 are attached to the ring 23. In order safely to be able to secure the loops by riveting, screwing, soldering, welding, or the like, metal sleeves are also provided within the ring 23.

For the stretching-out of the helix 15 when the spinnaker 1 is to be doused there is provided a downhaul 27 having a downhaul crowsfoot (bridle) 28. In an analogous way there is provided an uphaul 29 with an uphaul crowsfoot (bridle) 30 for the contracting of the helix 15 to a package when setting the spinnaker.

The downhaul crowsfoot 28 is fastened to the lower pair of loops 25 on the ring 23. The uphaul crowsfoot 30 is fastened to the pair of loops 24 on the opposite side of the ring 23. Thereafter the two ends of the uphaul crowsfoot 30 extend through a number of eyes 31 on the helix 15. The ends of the crowsfoot 30 thereafter extend through a pair of blocks 34 connected to the bolt 19. A lead block 37 for the uphaul 29 is provided on deck adjacent to the mast step. For the downhaul 27 there is provided a lead block 35 on the fore-deck close to the gunwhale on the leeward side. The two halyards 27 and 29 may eventually extend to the cockpit, from where the spinnaker can be set and doused without any man on the fore-deck which for safety reasons is of utmost importance in strong wind or heavy sea. The downhaul block 35 may for example be provided on the port side when the dousing has to be on the port bow. The leeward sheet 4 is let out and the downhaul 27 is pulled down from the cockpit. The helix then is stretched out, readily gliding against and embracing the spinnaker 1. When the spinnaker has to be set again, the helix 15 is pulled up again by means of the uphaul 29 from the cockpit. When the dousing has to be on the other bow the lead block 35 and the halyard 27 is shifted to the starboard side.

Figure 4:
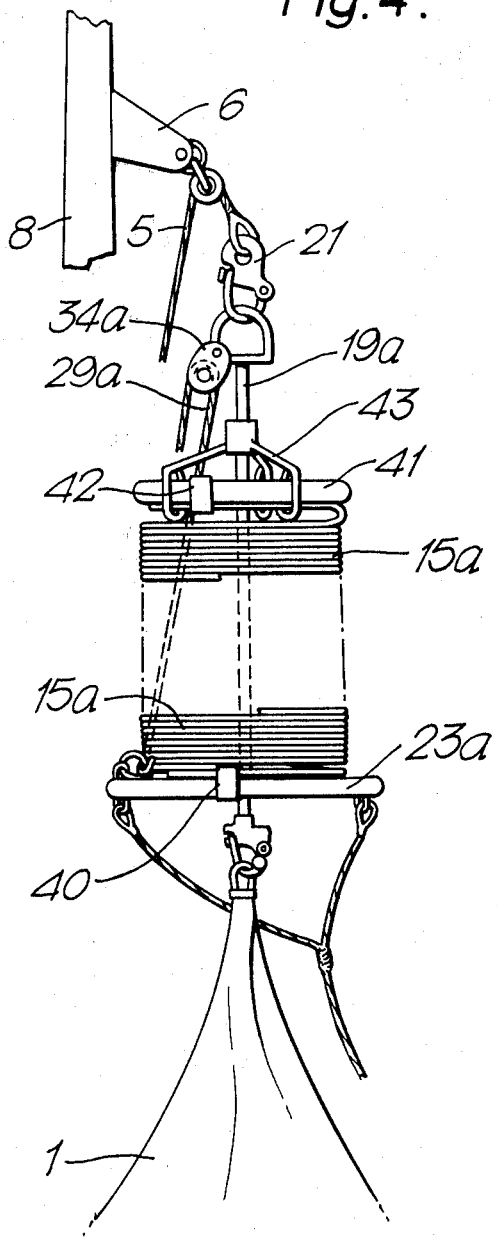
FIG. 4 illustrates a modified, even simpler, form of the device of the invention.

The device of the invention can be modified in various ways within the invention as defined by the accompanying claims. An embodiment which combines the merits of the device as shown in FIGS. 2 and 3 with a number of additional advantages is schematically illustrated in FIG. 4. This device is further simplified providing reduced production costs and at the same time facilitating the handling of the device. In FIG. 4 a helix is designated **15*a*. The ends of this helix 15*a* is secured to a lower ring 23*a* by means of a first clamping sleeve 40 and to an upper ring 41 by a second clamping sleeve 42. The upper ring 41 is mounted on a bolt 19*a* by means of three arms 43, which also assist in securing the helix 15*a* to the upper ring 41. On the upper side of the lower ring 23*a* there is provided only one loop 24*a*. An uphaul 29*a* is fastened to said single loop 23*a* and extends on the inner side of the helix 15*a* up to a block 34*a*. Other details in this Figure should not need any further explanation. The device is operated in the same manner as is described in connection with the embodiment of FIGS. 1 to 3. Experiments have proved that the fact that the uphaul 29*a* is provided inside the helix 15*a* may permit the elimination of other guiding means such as the loops 31 on the helix as well as the cone 17, FIGS. 2 and 3**.

I claim:

1. A device for setting and furling a sail of a sailing boat having a mast and associated running rigging, said device comprising an expandable open helix having a length when longitudinally expanded which is at least about the length of said sail and a diameter large enough to fit over said sail, one end of said helix being attached by running rigging to said mast and located proximate the head of the sail, expanding means for pulling the opposite end of the helix to longitudinally expand said helix around and over said sail to hold the sail in a furled condition during furling of said sail, and contraction means for longitudinally contracting said helix from the furling, expanded condition to a location proximate said sailhead during setting of said sail.

2. Device according to claim 1, wherein the lower end of said helix is fastened to a ring means for guiding the sail into the helix, and a downhaul and uphaul for the helix are fastened to said ring means.

3. Device according to claim 2, wherein the helix downhaul and the helix uphaul extend to the cockpit of the boat.

4. Device according to any one of claims 1, 2 or 3, wherein said device additionally includes centering means for the centering of the helix when the helix is contracted into a compact package upon sail setting.

5. Device according to claim 4, wherein said centering means comprises a member having an essentially conical shape tapering downwardly.

6. Device according to claim 4, wherein said centering device consists essentially of the helix uphaul, which for that purposes passes inside of said helix.

7. Device of claim 4, wherein said device additionally includes securing means for securing the head of the sail in the region of the central axis of the helix.

8. Device according to claim 4, wherein said helix is of a comparatively rigid material.

9. Device according to claim 8, wherein said helix is of hard plastic or steel or a combination of hard plastic and steel.

10. Device according to claim 4, wherein the helix includes a number of loop means for the guiding of the helix uphaul.

11. Device according to claim 4, wherein said helix is elastic.

12. Device according to claim 4, wherein said sail is a spinnaker.

* * * * *